US012635805B2

(12) United States Patent
Wang et al.

(10) Patent No.: US 12,635,805 B2
(45) Date of Patent: May 26, 2026

(54) ADJUSTABLE BED

(71) Applicant: Nisco Co., Ltd, Jiangsu (CN)

(72) Inventors: Wei Wang, Jiangsu (CN); Fahuan Zhang, Jiangsu (CN); Jian Xie, Jiangsu (CN); Yifan Mao, Jiangsu (CN)

(73) Assignee: NISCO CO., LTD, Rugao (CN)

( * ) Notice: Subject to any disclaimer, the term of this patent is extended or adjusted under 35 U.S.C. 154(b) by 307 days.

(21) Appl. No.: 18/203,750

(22) Filed: May 31, 2023

(65) Prior Publication Data

US 2023/0404275 A1 Dec. 21, 2023

(30) Foreign Application Priority Data

Jun. 17, 2022 (CN) ..... 202221538374.5

(51) Int. Cl.
*A47C 20/04* (2006.01)

(52) U.S. Cl.
CPC ..... *A47C 20/041* (2013.01)

(58) Field of Classification Search
CPC ..... A47C 19/122; A47C 20/041; A61G 7/015
USPC ..... 5/616
See application file for complete search history.

(56) References Cited

U.S. PATENT DOCUMENTS 11,399,998 B2 * 8/2022 Shih ..... A47C 20/041
2004/0148704 A1 * 8/2004 Tekulve ..... A61G 7/015 5/618
2008/0276373 A1 * 11/2008 Clenet ..... A47C 21/026 5/618
2009/0019640 A1 * 1/2009 Neuenswander ..... A61G 7/015 5/618
2009/0193587 A1 * 8/2009 Neuenswander .... A47C 20/041 5/618
2015/0121623 A1 * 5/2015 Huang ..... A61G 7/018 5/616
2017/0071356 A1 * 3/2017 Xu ..... A47C 20/041
2017/0360209 A1 * 12/2017 Zhou ..... A47C 20/041
2019/0021509 A1 * 1/2019 Shan ..... A47C 20/041
2020/0078238 A1 * 3/2020 Huang ..... A61G 7/012
2020/0214461 A1 * 7/2020 Wang ..... A47C 20/08
2021/0321785 A1 * 10/2021 Wang ..... A47C 21/00
2022/0095803 A1 * 3/2022 Wang ..... A47C 20/08
2022/0361682 A1 * 11/2022 Chen ..... A47C 20/041
2024/0099472 A1 * 3/2024 Deng ..... A47C 20/041

* cited by examiner

*Primary Examiner* — Myles A Throop
(74) *Attorney, Agent, or Firm* — troutman pepper locke; Tim Tingkang Xia, Esq.

(57) ABSTRACT

An adjustable bed includes a frame structure comprising: a base structure having a base body and a back support member pivotally connected to the base body; and a bed frame slidably arranged on the base body of the base structure; a driving mechanism comprising a back lifting actuator having a first end and an opposite, second end pivotally connected to the base structure and the bed frame, respectively; and a plurality of platforms including a seat platform fixed to the bed frame and a back platform hinged to the seat platform and pivotally supported by the back support member, such that in operation the back lifting actuator drives the bed frame to slidably move on the base body of the base structure, which in turn drives the back platform to translationally and rotationally move in desired positions and angels relative to the base structure.

7 Claims, 8 Drawing Sheets

ADJUSTABLE BED

CROSS-REFERENCE TO RELATED PATENT APPLICATION

This application also claims priority to and the benefit of Chinese Patent Application No. 202221538374.5, filed Jun. 17, 2022, which is incorporated herein in its entirety by reference.

FIELD OF THE INVENTION

The invention generally relates to a bed, and more particular to an adjustable bed.

BACKGROUND OF THE INVENTION

Sleep is critical for people in every aspect of their lives. Beds are necessary furniture for people to sleep on. Adjustable beds are used more and more in healthcare and home. However, the adjustability of conventional adjustable beds is very limited. In addition, the frame structures of the conventional adjustable beds are not foldable, which may use a great amount of materials for package and occupy a large space during transportation and/or storage. Thus, it would be beneficial and desirable for people to have a bed system that is capable of adjusting body positions at user's preference so that the user achieves maximum comfort when using the bed system. Further, it is beneficial and desirable for people to have a portable bed system that is easy for package, transportation, and/or storage.

SUMMARY OF THE INVENTION

In one aspect, the invention relates to an adjustable bed, comprising a frame structure comprising: a base structure; a back support member pivotally connected to the base structure; and a bed frame slidably arranged on the base structure; a driving mechanism comprising a back lifting actuator having a first end and an opposite, second end pivotally connected to the base structure and the bed frame, respectively; and a plurality of platforms including a seat platform fixed to the bed frame and a back platform hinged to the seat platform and pivotally supported by the back support member, such that in operation the back lifting actuator drives the bed frame to slidably move on the base structure, which in turn drives the back platform to translationally and rotationally move in desired positions and angles relative to the base structure.

In one embodiment, the driving mechanism further comprises a foot lifting assembly comprising a foot lifting bracket pivotally connected to the bed frame, and a foot lifting actuator pivotally connected between the foot lifting bracket and the bed frame for operably driving the foot lifting bracket to pivotally move in an upward rotation direction or a downward rotation direction relative to the bed frame.

In one embodiment, the plurality of platforms further comprises a thigh platform hinged to the seat platform and a foot platform hinged to the thigh platform, wherein the thigh platform and the foot platform are co-movably coupled with the foot lifting bracket, such that positions and angles of the thigh platform and the foot platform are adjustable by the foot lifting bracket.

In one embodiment, the base structure comprises a first base structure and a second base structure, wherein each of the first base structure and the second base structure has a pair of side rails, an upper rail and a lower rail, wherein the pair of side rails is transversely spaced, longitudinally aligned and arranged parallel to each other, each side rail having an upper end portion and an opposite, lower end portion; wherein two ends of the upper rail are rigidly connected to the upper end portions of the pair of side rails; and two ends of the lower rail are rigidly connected to the lower end portions of the pair of side rails such that the pair of side rails, the upper rail, and the lower rail are in a rectangle form, wherein the lower ends of the pair of side rails of the first base structure are pivotally connected to the upper ends of the pair of side rails of the second base structure, respectively, so that the first base structure and the second base structure are foldable to each other.

In one embodiment, the bed frame comprises a first bed frame and a second bed frame slidably arranged on the first base structure and the second base structure, respectively, wherein each of the first bed frame and the second bed frame has a pair of side rails, an upper rail and a lower rail, wherein the pair of side rails is transversely spaced, longitudinally aligned and arranged parallel to each other, and wherein the upper rail and the lower rail are rigidly connected to the pair of side rails such that the pair of side rails, the upper rail, and the lower rail are in a rectangle form.

In one embodiment, each side rail of the first base structure and the second base structure includes a guiding means, and wherein each side rail of the first bed frame and the second bed frame includes at least one slider slidably received in the respective guiding means.

In one embodiment, each side rail of the first base structure and the second base structure is formed of a C-shaped steel having a C-channel, and wherein each side rail of the first bed frame and the second bed frame includes at least one wheel slidably received in the respective C-channel.

In one embodiment, the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the first base structure, and the activation rod has a distal end portion pivotally connected to the upper rail of the first bed frame, or the motor member is pivotally connected to the upper rail of the first bed frame, and the activation rod has a distal end portion pivotally connected to the lower rail of the first base structure.

In one embodiment, the foot lifting bracket comprises a pair of swing arms and a middle bar, wherein the pair of swing arms is transversely spaced and longitudinally extended, and rigidly connected to two ends of the transversely extending middle bar in an H-shaped form, and each swing arm has a first end portion and an opposite, second end portion, wherein the first end portion of each swing arm is pivotally mounted to a respective one of the pair of side rails of the second bed frame.

The foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the second bed frame, and the activation rod has a distal end portion pivotally connected to the middle bar of the foot lifting bracket, or the motor member is pivotally connected to the middle bar of the foot lifting bracket, and the activation rod has a distal end portion pivotally connected to the lower rail of the second bed frame.

In one embodiment, the second end portion of each of the pair of swing arms is equipped with at least one foot lifting wheel.

In one embodiment, the base structure comprises a pair of side rails, an upper rail, an intermediate rail and a lower rail, wherein the pair of side rails is transversely spaced, longitudinally aligned and arranged parallel to each other, each side rail having an upper end portion and an opposite, lower end portion; wherein two ends of the upper rail are connected to the upper end portions of the pair of side rails; two ends of the lower rail are connected to the lower end portions of the pair of side rails; and two ends of the intermediate rail are connected to the pair of side rails at a position between the upper end portions and the lower end portions of the pair of side rails, such that the pair of side rails, the upper rail, the intermediate rail and the lower rail are rectangle forms.

In one embodiment, the bed frame comprises a first bed frame and a second bed frame slidably arranged on the base structure, wherein each of the first bed frame and the second bed frame has a pair of side rails, an upper rail and a lower rail, wherein the pair of side rails is transversely spaced, longitudinally aligned and arranged parallel to each other, and wherein the upper rail and the lower rail are rigidly connected to the pair of side rails such that the pair of side rails, the upper rail, and the lower rail are in a rectangle form.

In one embodiment, each side rail of the base structure includes a guiding means, and wherein each side rail of the first bed frame and the second bed frame includes at least one slider slidably received in the respective guiding means.

In one embodiment, each side rail of the base structure is formed of a C-shaped steel having a C-channel, and wherein each side rail of the first bed frame and the second bed frame includes at least one wheel slidably received in the respective C-channel.

In one embodiment, the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the intermediate rail of the base structure, and the activation rod has a distal end portion pivotally connected to the upper rail of the first bed frame, or the motor member is pivotally connected to the upper rail of the first bed frame, and the activation rod has a distal end portion pivotally connected to the intermediate rail of the first base structure.

In one embodiment, the foot lifting bracket comprises a pair of swing arms and a middle bar, wherein the pair of swing arms is transversely spaced and longitudinally extended, and rigidly connected to two ends of the transversely extending middle bar in an H-shaped form, and each swing arm has a first end portion and an opposite, second end portion, wherein the first end portion of each swing arm is pivotally mounted to a respective one of the pair of side rails of the second bed frame.

The foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the second bed frame, and the activation rod has a distal end portion pivotally connected to the middle bar of the foot lifting bracket, or the motor member is pivotally connected to the middle bar of the foot lifting bracket, and the activation rod has a distal end portion pivotally connected to the lower rail of the second bed frame.

In one embodiment, each of the base structure and the bed frame comprises a pair of side rails, an upper rail, an intermediate rail and a lower rail, wherein the pair of side rails is transversely spaced, longitudinally aligned and arranged parallel to each other, each side rail having an upper end portion and an opposite, lower end portion; wherein two ends of the upper rail are connected to the upper end portions of the pair of side rails; two ends of the lower rail are connected to the lower end portions of the pair of side rails; and two ends of the intermediate rail are connected to the pair of side rails at a position between the upper end portions and the lower end portions of the pair of side rails, such that the pair of side rails, the upper rail, the intermediate rail and the lower rail are rectangle forms.

In one embodiment, each side rail of the base structure includes a guiding means, and wherein each side rail of the bed frame includes at least one slider slidably received in the respective guiding means.

In one embodiment, each side rail of the base structure is formed of a C-shaped steel having a C-channel, and wherein each side rail of the bed frame includes at least one wheel slidably received in the respective C-channel.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
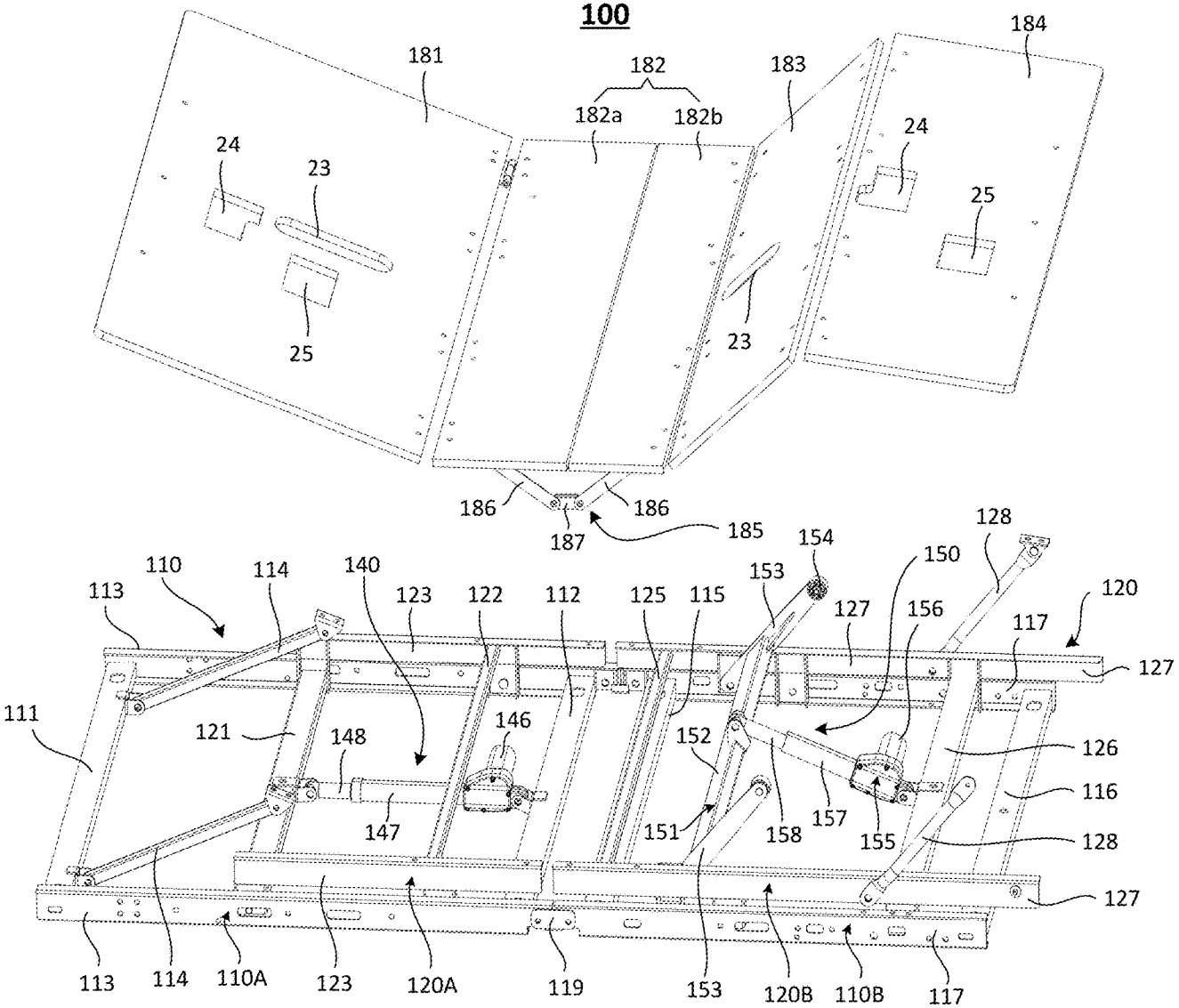
FIG. 1 shows schematically a partially exploded, front perspective view of an adjustable bed according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Furthermore, relative terms, such as "lower" or "bottom" and "upper" or "top" may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower", can therefore, encompasses both an orientation of "lower" and "upper" depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising" or "includes" and/or "including" or "has" and/or "having", or "carry" and/or "carrying," or "contain" and/or "containing" or "involve" and/or "involving", and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

As used in this disclosure, the term "platform(s)" refers to bed platform(s), or bed board(s).

The description will be made as to the embodiments of the invention in conjunction with the accompanying drawings in FIGS. 1-10. In accordance with the purposes of this invention, as embodied and broadly described herein, this invention, in one aspect, relates to an adjustable bed with tilting mechanisms.

Figure 2:
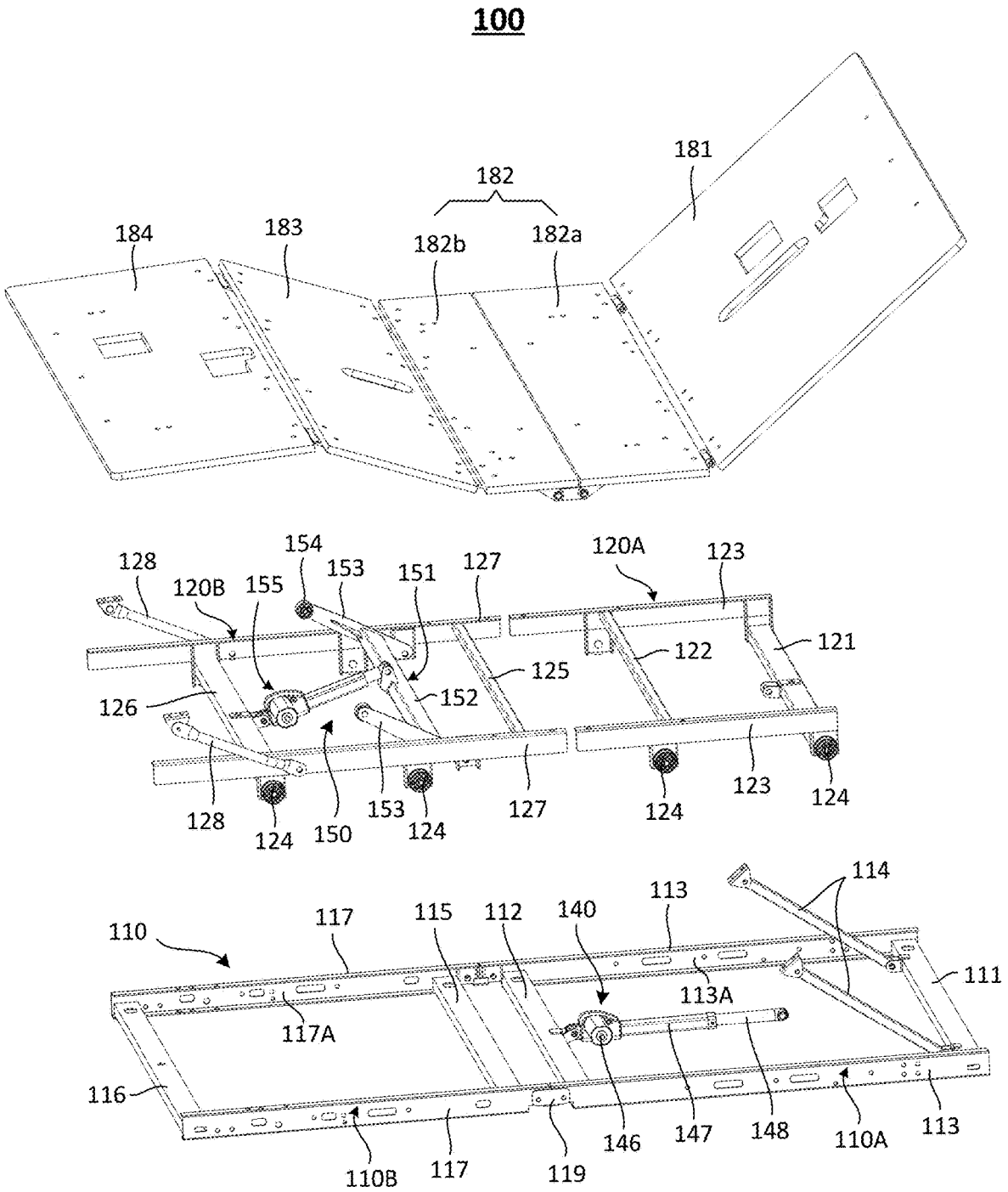
FIG. 2 shows schematically another partially exploded, front perspective view of the adjustable bed shown in FIG. 1.
Figure 3:
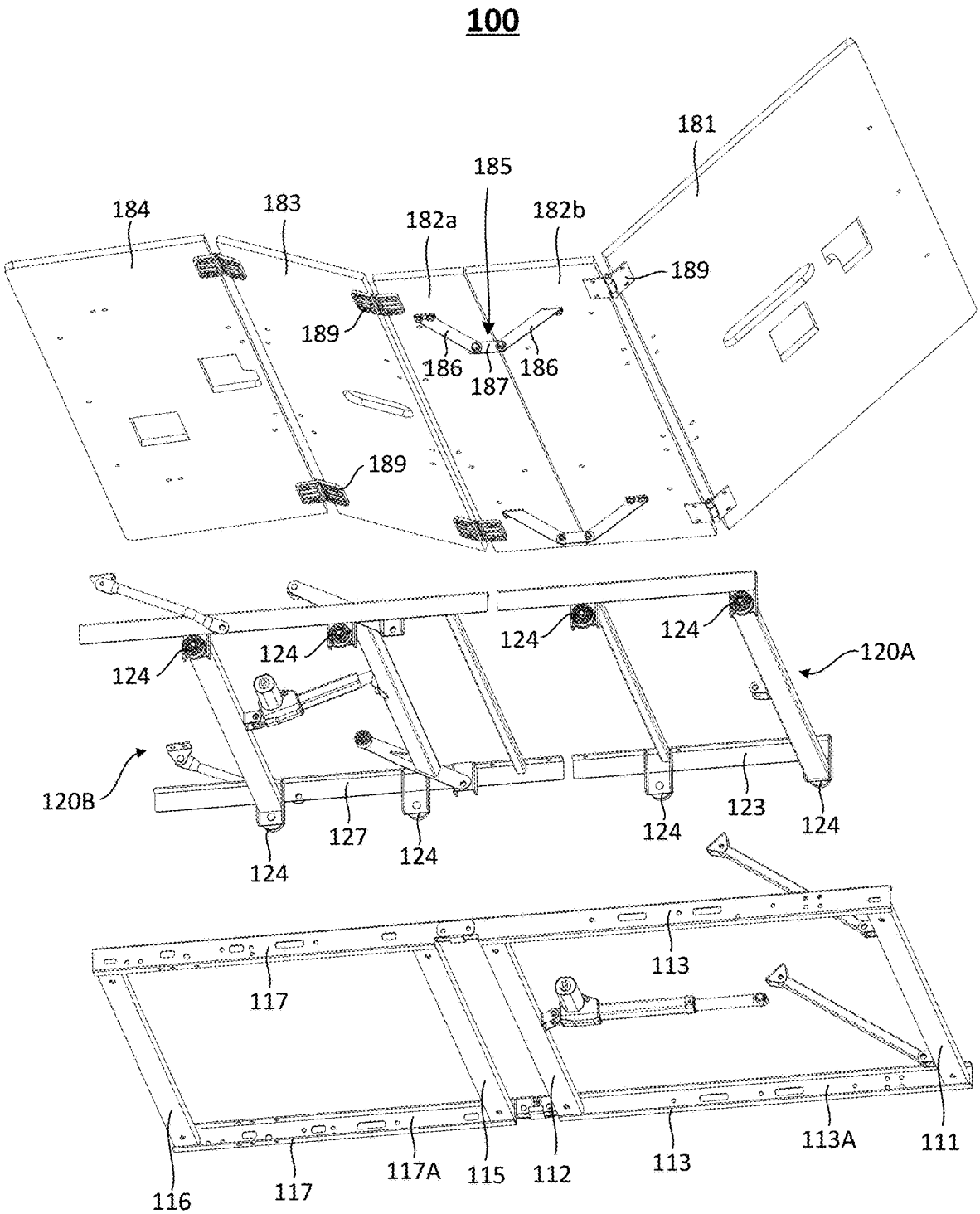
FIG. 3 shows schematically a partially exploded, rear perspective view of the adjustable bed shown in FIG. 1.
Figure 4:
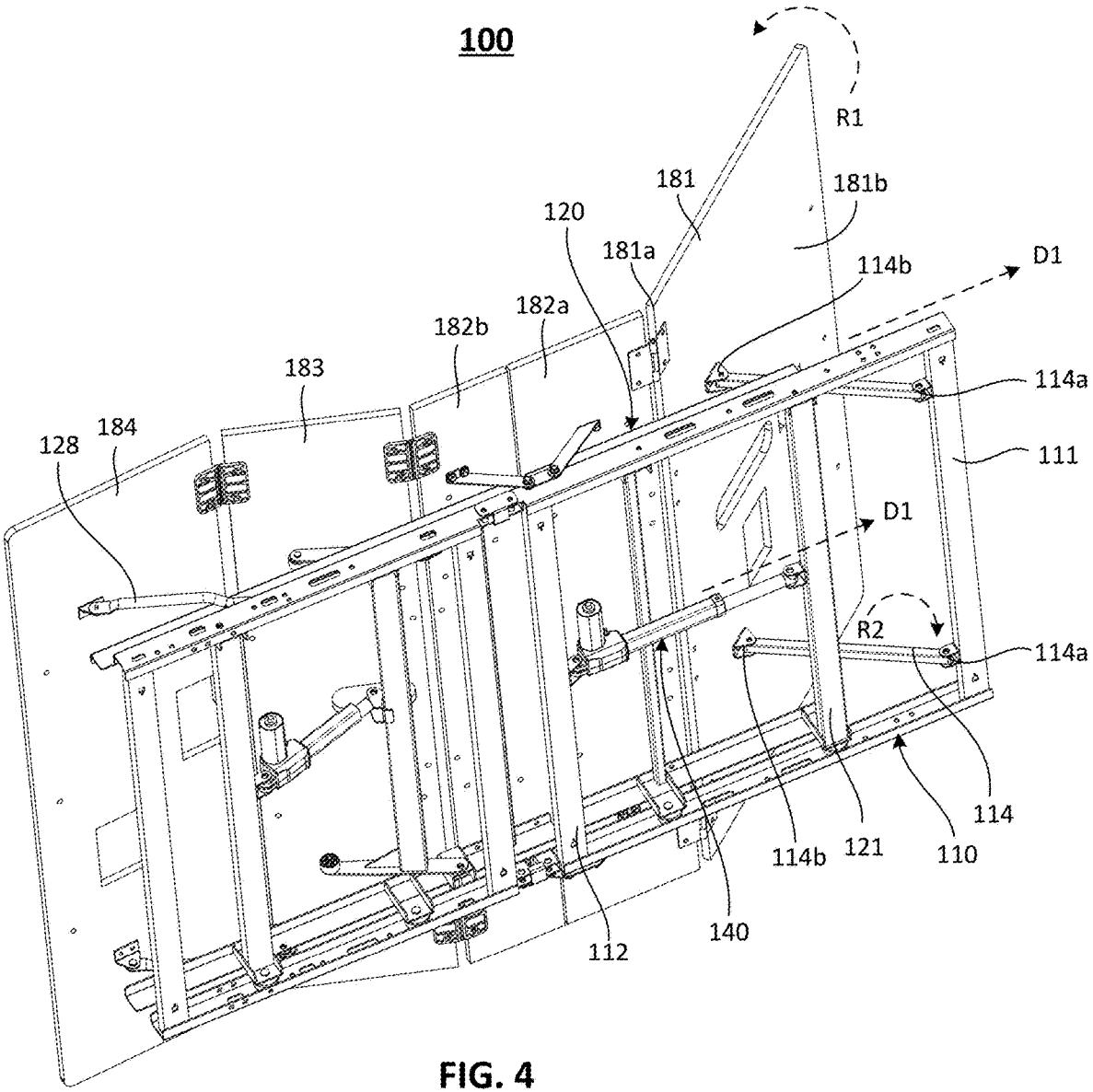
FIG. 4 shows schematically a rear perspective view of the adjustable bed shown in FIG. 1 in a sloping position.
Figure 5:
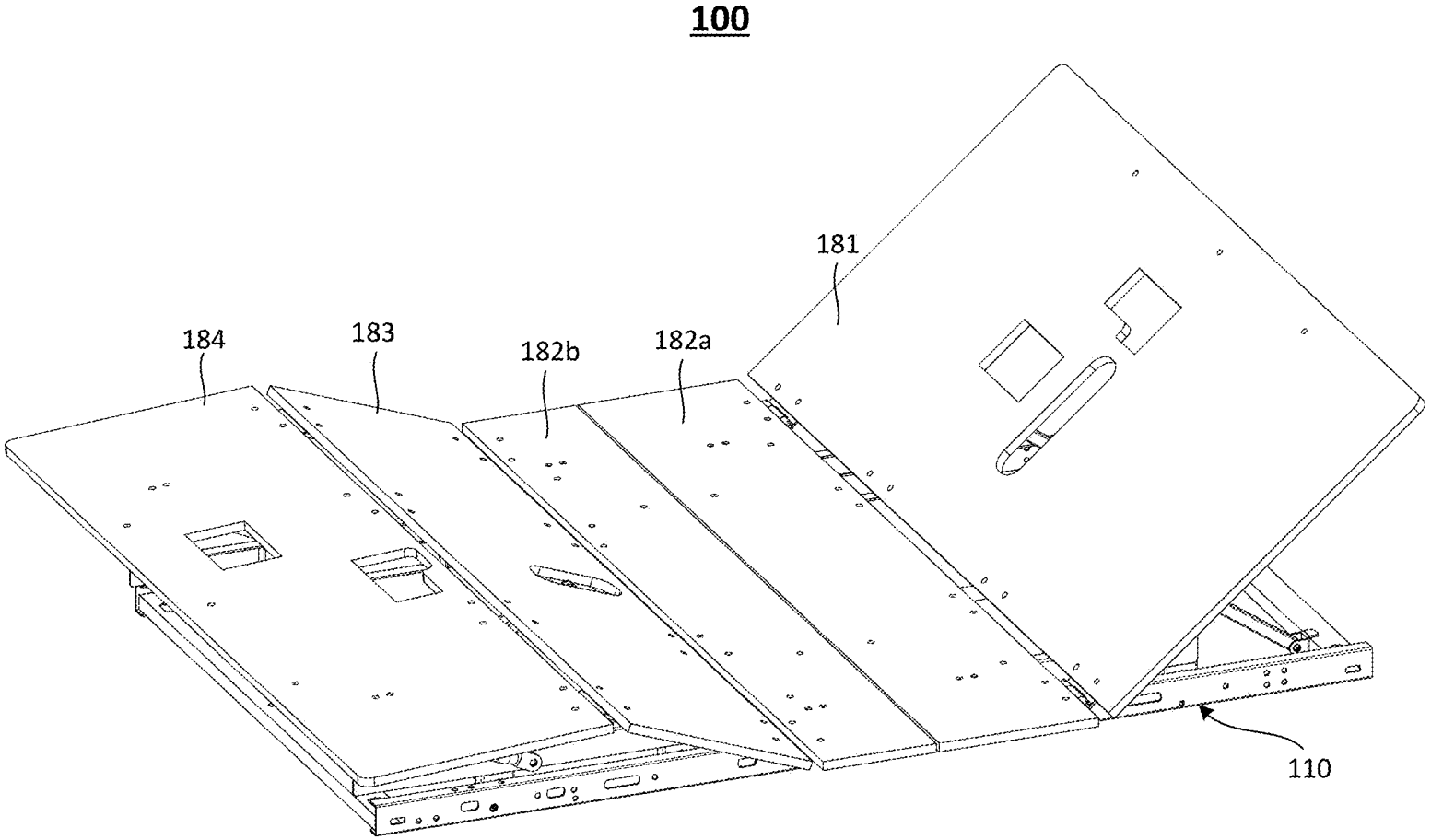
FIG. 5 shows schematically a front perspective view of the adjustable bed shown in FIG. 1 in a sloping position.

Referring to FIGS. 1-10, the adjustable bed 100 is shown according to one embodiment of the invention. The adjustable bed 100 includes a frame structure including a base structure 110; a back support member 114 pivotally and directly connected to the base structure 110; and a bed frame 120 slidably arranged on the base structure 110; a plurality of platforms disposed on the frame structure; and a driving mechanism coupled between the frame structure and the plurality of platforms for operably adjusting positions and angles of the plurality of platforms according to user's preference. Specifically, as shown in FIG. 4, the platforms include a seat platform 182 fixed to the bed frame 120 and a back platform 181 having a lower edge 181*a* hinged to the seat platform 182; and the back support member 114 has a first end 114*a* pivotally connected to the front rail 112 of the base and an opposite, second end 114*b* directly hinged to a rear side 181*b* of the back platform 181. As such an arrangement, the seat platform 182 is co-movable with the bed frame 120, and when the seat platform 192 translationally moves along a translational direction D1, the movement of the seat platform 182 causes the back platform 181 to translationally move along with the translational direction D1 and rotate around its lower edge 181*a* hinged to the seat platform 182 at a rotational direction R1, and the back support member 114 to rotate at a rotational direction R2 that is opposite to the rotational direction R1 of the back platform 181.

Figure 6:
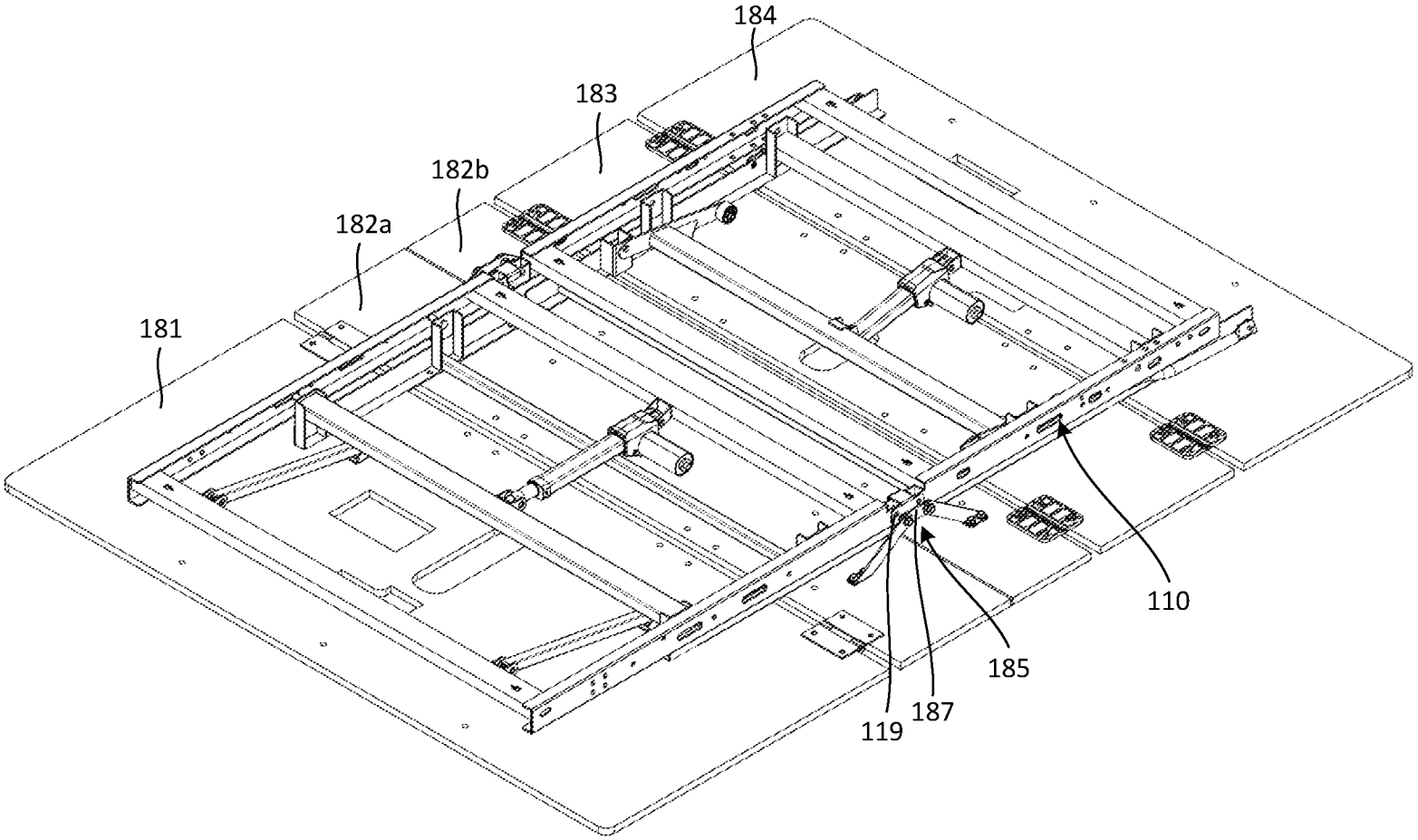
FIG. 6 shows schematically a rear perspective view of the adjustable bed shown in FIG. 1 in a flat position.
Figure 7:
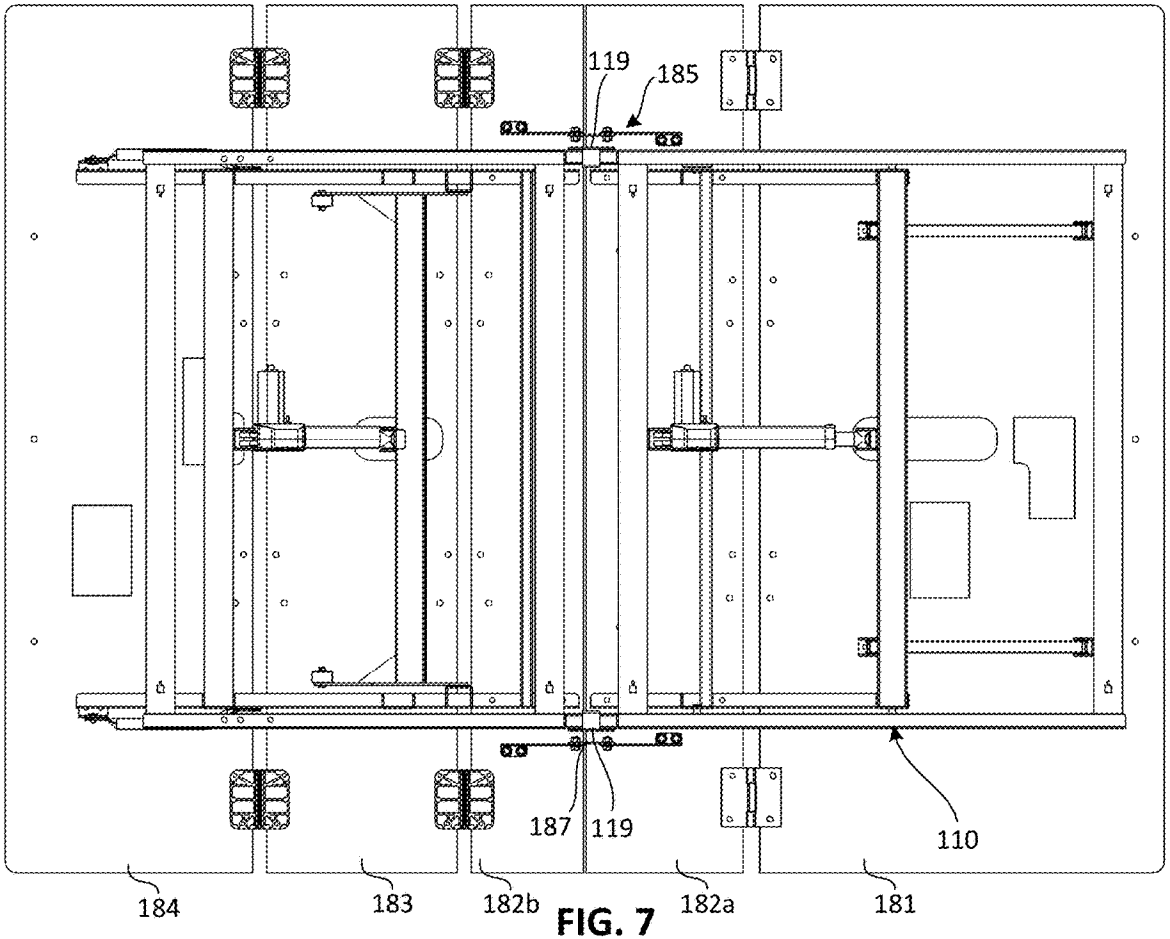
FIG. 7 shows schematically a bottom view of the adjustable bed shown in FIG. 1 in a flat position.
Figure 8:
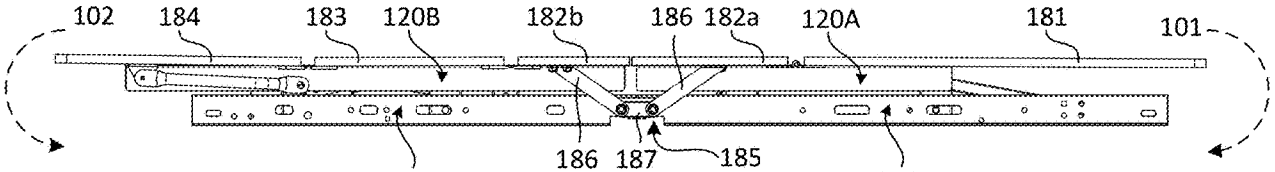
FIG. 8 shows schematically a side view of the adjustable bed shown in FIG. 1 in a flat position.
Figure 9:
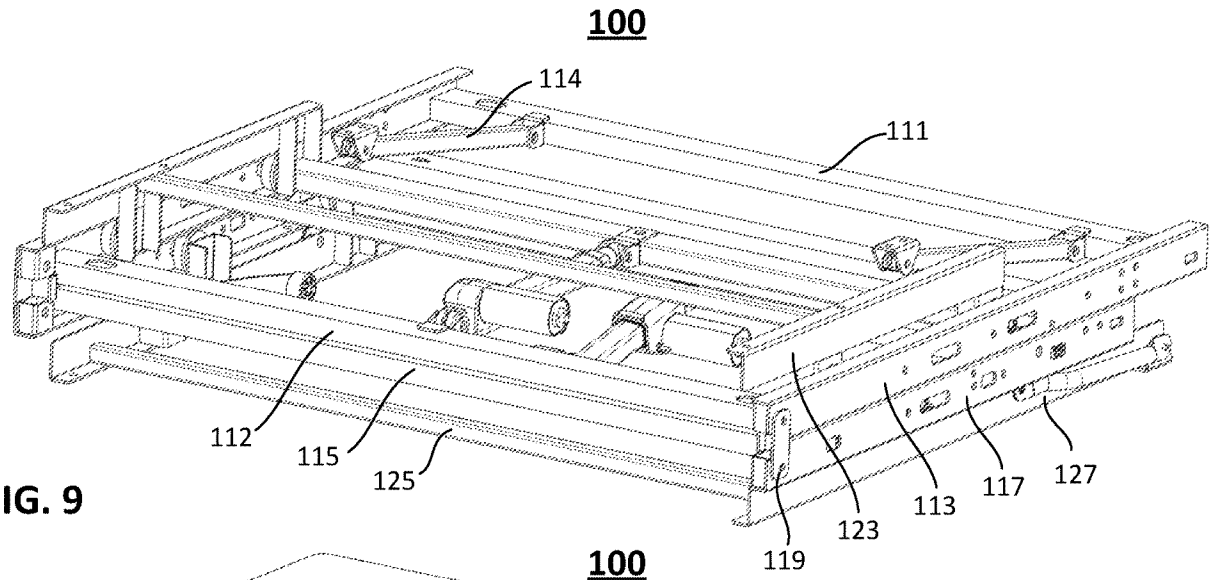
FIG. 9 shows schematically a perspective view of the adjustable bed in FIG. 1 in a folded position.
Figure 10:
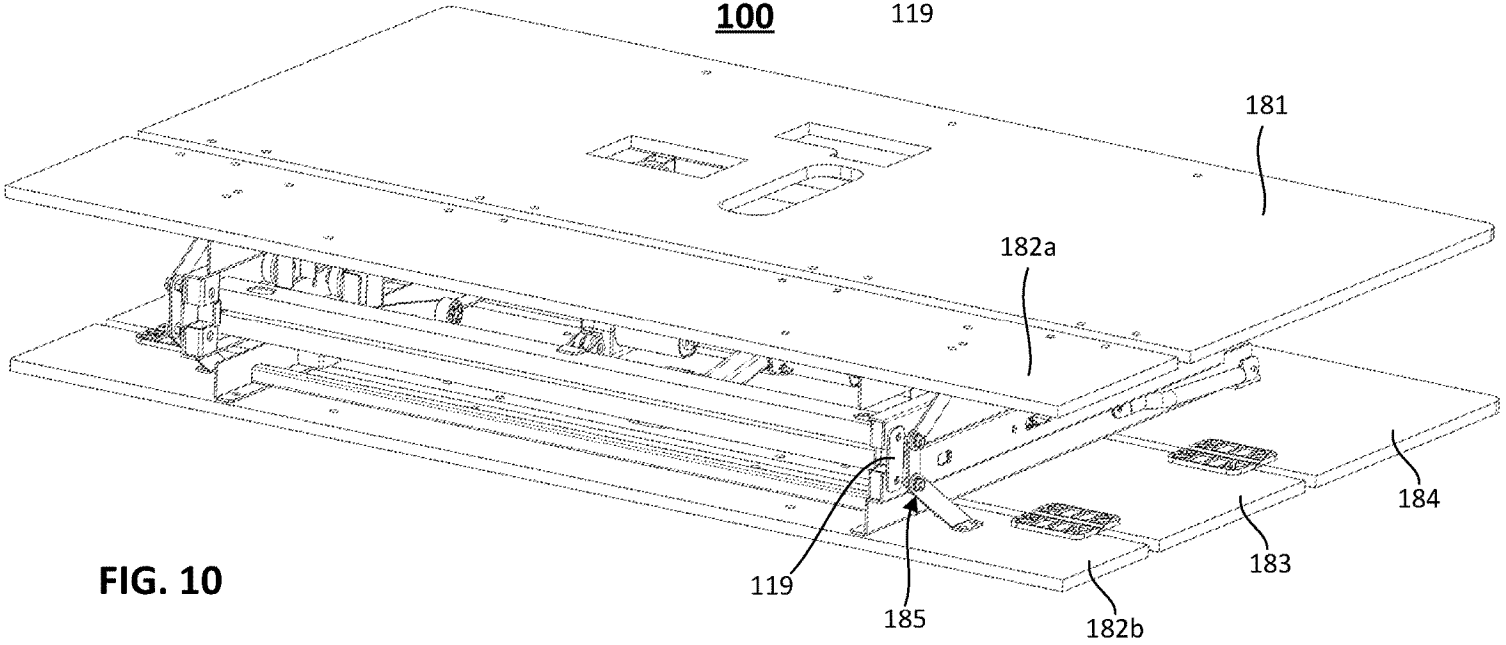
FIG. 10 shows schematically another perspective view of the adjustable bed shown in FIG. 1 in a folded position.

The plurality of platforms has a back platform 181, a seat platform 182, a thigh platform 183 and a foot platform 184. The seat platform 182 is fixed to the bed frame 120, the back platform 181 is hinged to one edge of the seat platform 182, the thigh platform 183 is hinged to another edge of the seat platform 182 and the foot platform 184 is hinged to the thigh platform 183. In one embodiment, the seat platform 182 includes a first seat platform 182*a* and a second seat platform 182*b* that are hinged to each other by a hinge 185. The hinge 185 has a middle bar 187 and a pair of side bars 186, where each side bar 186 has one end pivotally connected to the middle bar 187 and another end fixed to a respective one of the first seat platform 182*a* and the second seat platform 182*b*, as shown in FIGS. 1 and 3. In one embodiment, when the plurality of platforms is in a flat position, the middle bar 187 and the connectors 119 are projectively overlapped along a transverse direction, the center line between the middle bars 187 on the two sides of the frame structure is coincident with that of the connectors 119 on the pair of side rails 113 and 117, as shown in FIGS. 6-8. In addition, the total width of the back platform 181 and the first seat platform 182*a* is substantially same as that of the second seat platform 182*b*, the thigh platform 183 and the foot platform 184, so that when the adjustable bed 100 is folded, the back platform 181 and the first seat platform 182*a* on one side and the second seat platform 182*b*, the thigh platform 183 and the foot platform 184 on the other side occupy the similar space, as shown in FIG. 10, which is convenient for package and/or storage.

In some embodiments, as shown in FIG. 1, the back platform 181 may have openings 23, 24 and 25 for accommodating, for example, the activation rod 147, the motor member 146 of the back lifting actuator 140, and a vibration or massage motor, respectively; the thigh platform 183 may have one opening 23 for accommodating the activation rod 157 of the foot lifting actuator 155; the foot platform 184 may have openings 24 and 25 for accommodating the motor member 156 of the foot lifting actuator 155, and a vibration or massage motor, respectively.

The back support member 114 has one end pivotally connected to the base structure 110 and another end pivotally connected to the back platform 181.

The driving mechanism includes a back lifting actuator 140 having a first end and an opposite, second end pivotally connected to the base structure 110 and the bed frame 120, respectively. As such, in operation, the back lifting actuator 140 drives the bed frame 120 to slidably move on the base structure 110 in the translational direction D1, thereby driving the seat platform 182 to translationally move accordingly, and the movement of the seat platform 182 in turn drives the back platform 181 to translationally move along with the movement of the seat platform 182 and rotate around its lower edge 181*b* hinged to the seat platform 182 in the rotational direction R1, and the back support member 114 to rotate in the rotational direction R2 opposite to the rotational direction R1 of the back platform so as to adjust the back platform 182 in desired positions and angles relative to the base structure 110, as shown in FIG. 4.

The driving mechanism further includes a foot lifting assembly 150 having a foot lifting bracket 151 pivotally connected to the bed frame 120, and a foot lifting actuator 155 pivotally connected between the foot lifting bracket 151 and the bed frame 120 for operably driving the foot lifting bracket 151 to pivotally move in an upward rotation direction or a downward rotation direction relative to the bed frame 120. The thigh platform 183 and the foot platform 184 are co-movably coupled with the foot lifting bracket 151, such that positions and angles of the thigh platform 183 and the foot platform 184 are adjustable by positions and angles of the foot lifting bracket 151.

Specifically, in the exemplary embodiment shown in FIGS. 1-10 and particularly FIGS. 1-3, the base structure 110 comprises a first base structure 110A and a second base structure 110B. The first base structure 110A has an upper rail 111, a lower rail 112, and a pair of side rails 113, each of which is a straight rail. The pair of side rails 113 is transversely spaced, longitudinally aligned and arranged parallel to each other. Each side rail 113 has an upper end portion and an opposite, lower end portion. Two ends of the upper rail 111 are directly and rigidly connected to the upper end portions of the pair of side rails 113; and two ends of the lower rail 112 are directly and rigidly connected to the lower end portions of the pair of side rails 113 such that the upper rail 111, the lower rail 112 and the pair of side rails 113 are in a rectangle form. Preferably, the direct and rigid connections of the pair of side rails 113 to the upper and lower rails 111 and 112 are by respectively welding two ends of the upper rail 111 directly onto the upper end portions of the pair of side rails 113, and respectively welding two ends of the lower rail 112 directly onto the lower end portions of the pair of side rails 113. Other direct and rigid connecting means can also be utilized to practice the invention. The back support member 114 includes a pair of back support rods 114 having one ends pivotally connected to the upper rail 111 of the first base structure 110A, as shown in FIGS. 1-2.

Similarly, the second base structure 110B has an upper rail 115, a lower rail 116, and a pair of side rails 117, each of which is also a straight rail. The pair of side rails 117 is transversely spaced, longitudinally aligned and arranged parallel to each other. Each side rail 117 has an upper end portion and an opposite, lower end portion. Two ends of the upper rail 115 are directly and rigidly connected to the upper end portions of the pair of side rails 117; and two ends of the lower rail 116 are directly and rigidly connected to the lower end portions of the pair of side rails 117 such that the upper rail 115, the lower rail 116 and the pair of side rails 117 are in a rectangle form. Preferably, the direct and rigid connections of the pair of side rails 117 to the upper and lower rails 115 and 116 are by respectively welding two ends of the upper rail 115 directly onto the upper end portions of the pair of side rails 117, and respectively welding two ends of the lower rail 116 directly onto the lower end portions of the pair of side rails 117. Other direct and rigid connecting means can also be utilized to practice the invention.

In one embodiment, the lower ends of the pair of side rails of the first base structure 110A are pivotally connected to the upper ends of the pair of side rails of the second base structure 110B, respectively, by connectors 119, so that the first base structure 110A and the second base structure 110B are foldable to each other.

The bed frame 120 comprises a first bed frame 120A and a second bed frame 120B slidably arranged on the first base structure 110A and the second base structure 110B, respectively, as shown in FIGS. 1-3.

The first bed frame 120A has an upper rail 121, a lower rail 122, and a pair of side rails 123, each of which is a straight rail. The pair of side rails 123 is transversely spaced, longitudinally aligned and arranged parallel to each other. The upper rail 121 and the lower rail 122 are rigidly connected to the pair of side rails 123 such that the upper rail 121, the lower rail 122 and the pair of side rails 123 are in a rectangle form. The rigid connections of the upper rail 121 and the lower rail 122 to the pair of side rails 123 are by welding or other rigid connecting means.

Similarly, the second bed frame 120B has an upper rail 125, a lower rail 126, and a pair of side rails 127, each of which is also a straight rail. The pair of side rails 127 is transversely spaced, longitudinally aligned and arranged parallel to each other. The upper rail 125 and the lower rail 126 are rigidly connected to the pair of side rails 127 such that the upper rail 125, the lower rail 126 and the pair of side rails 127 are in a rectangle form. The rigid connections of the upper rail 125 and the lower rail 126 to the pair of side rails 127 are by welding or other rigid connecting means. In addition, the second bed frame 120B also has a pair of foot support members 128, each foot support member 128 having one end pivotally connected to a respective one of the pair of side rails 127 and another end pivotally connected to the foot platform 184, as shown in FIG. 4.

In some embodiments, each side rail 113 or 117 of the first base structure 110A and the second base structure 110B includes a guiding means 113A or 117A, and each side rail 123 or 127 of the first bed frame 120A and the second bed frame 120B includes at least one slider 124 slidably received in the respective guiding means 113A or 117A. As such an arrangement, the first bed frame 120A and the second bed frame 120B are slidably movable on the first base structure 110A and the second base structure 110B, respectively. The slidable movement of the first bed frame 120A on the first base structure 110A is limited between the upper rail 111 and the lower rail 112 of the first base structure 110A. That is, the movement of the slider 124 of the first bed frame 120A is limited by the upper rail 111 and the lower rail 112 of the first base structure 110A. Similarly, the slidable movement of the second bed frame 120B on the second base structure 110B is limited between the upper rail 115 and the lower rail 116 of the second base structure 110B. That is, the movement of the slider 124 of the second bed frame 120B is limited by the upper rail 115 and the lower rail 116 of the second base structure 110B.

Specifically, as shown in FIG. 2, each side rail 113 or 117 of the first base structure 110A and the second base structure 110B is formed of a C-shaped steel having a C-channel 113A or 117A, and each side rail 123 or 127 of the first bed frame 120A and the second bed frame 120B includes two wheels 124 slidably received in the respective C-channel 113A or 117A.

The back lifting actuator 140 comprises a motor member 146, an outer tube 147 extending from the motor member 146, an activation rod 148 received in the outer tube 147, engaged with the motor member 146 and configured to be telescopically expandable or contractible relative to the outer tube 147 according to a direction of motor rotation. The motor member 146 is pivotally connected to the lower rail 112 of the first base structure 110A, and the activation rod 148 has a distal end portion pivotally connected to the upper rail 121 of the first bed frame 120A, as shown in FIG. 1. Alternatively, the motor member 146 is pivotally connected to the upper rail 121 of the first bed frame 120A, and the activation rod 148 has a distal end portion pivotally connected to the lower rail 112 of the first base structure 110A.

As such, when the activation rod 148 of the back lifting actuator 140 is expanded, e.g., in the directions D1 (FIG. 4), it pushes the first bed frame 120A to slidably move on the pair of side rails 113 of the first base structure 110A toward the upper rail 111 of the first base structure 110A along the directions D1, which in turn drives the back platform 181 to translationally move toward the upper rail 111 of the first base structure 110A along the directions D1, and rotate around its lower edge 181*a* hinged to the first seat platform 182*a* in an upward rotation direction R1, and the back support member 114 to rotate in the rotational direction R2 opposite to the rotational direction R1 of the back platform 181 so that the state of the back platform 181 can be adjusted from a horizontal position to a sloping/inclining position relative to the base structure 110, as shown in FIGS. 1-5. When the activation rod 148 of the back lifting actuator 140 is contracted in an opposite direction of D1, it pulls the first bed frame 120A to slidably move on the pair of side rails 113 of the first base structure 110A toward the lower rail 112 of the first base structure 110A in the opposite direction of D1, which in turn drives the back platform 181 to translationally move toward the lower rail 112 of the first base structure 110A and rotate around its lower edge 181*a* hinged to the first seat platform 182*a* in an downward rotation direction (an opposite direction of R1, i.e., the rotational direction R2), and the back support member 114 to rotate in an upward rotation direction R1 opposite to the downward rotation direction R2 of the back platform 181, so that the state of the back platform 181 can be adjusted from the sloping/inclining position to the horizontal position relative to the base structure 110, as shown in FIGS. 6-8.

As shown in FIG. 1, the foot lifting bracket 151 comprises a pair of swing arms 153 and a middle bar 152, wherein the pair of swing arms 153 is transversely spaced and longitudinally extended, and rigidly connected to two ends of the transversely extending middle bar 152 in an H-shaped form, and each swing arm 153 has a first end portion and an opposite, second end portion, wherein the first end portion of each swing arm 153 is pivotally mounted to a respective one of the pair of side rails 127 of the second bed frame 120B. The second end portion of each of the pair of swing arms 153 is equipped with at least one foot lifting wheel 154. The rigid connections of the middle bar 152 to the pair of swing arms 153 are by welding or other rigid connecting means.

The foot lifting actuator 155 comprises a motor member 156, an outer tube 157 extending from the motor member 156, an activation rod 158 received in the outer tube 157, engaged with the motor member 156 and configured to be telescopically expandable or contractible relative to the outer tube 157 according to a direction of motor rotation. The motor member 156 is pivotally connected to the lower rail 126 of the second bed frame 120B, and the activation rod 158 has a distal end portion pivotally connected to the middle bar 152 of the foot lifting bracket 151, as shown in FIG. 1. Alternatively, the motor member 156 is pivotally connected to the middle bar 152 of the foot lifting bracket 151, and the activation rod 158 has a distal end portion pivotally connected to the lower rail 126 of the second bed frame 120B.

As such, when the activation rod 158 of the foot lifting actuator 155 is expanded, it drives the foot lifting bracket 151 to rotate in an upward rotation direction along the pivot point at in the first end portion of each swing arm 153 of the foot lifting bracket 151, which in turn causes the thigh platform 183 to sildably move against the foot lifting wheels 154 in the same upward rotation direction. The movement of the thigh platform 8 in the same upward rotation direction in turn causes the foot platform 184 to move accordingly, so that the thigh platform 183 and the foot platform 184 are in a desired adjusting position, as shown in FIGS. 1-5. When the activation rod 158 of the foot lifting actuator 155 is contracted, it drives the foot lifting bracket 151 to rotate in an downward rotation direction along the pivot point at in the first end portion of each swing arm 153 of the foot lifting bracket 151, which in turn causes the thigh platform 183 to sildably move against the foot lifting wheels 154 in the same downward rotation direction. The movement of the thigh platform 183 in the same downward rotation direction in turn causes the foot platform 184 to move, so that the thigh platform 183 and the foot platform 184 are in a flat position when the activation rod 158 of the foot lifting actuator 155 is contracted at most, as shown in FIGS. 6-8.

In the exemplary embodiments, the first base structure 110A and the second base structure 110B are hinged to each other by the connectors 119, and the first seat platform 182*a* and the second seat platform 182*b* are hinged to each other by the hinge 185, the center distance of the middle bars 187 on the two sides and that of the connectors 119 have the same height, the adjustable bed 100 is foldable around the center of the connectors 119 or the middle bar 187 along the rotation directions 101 and 102 shown in FIG. 8. Since the total width of the back platform 181 and the first seat platform 182*a* is substantially same as that of the second seat platform 182*b*, the thigh platform 183 and the foot platform 184, when the adjustable bed 100 is folded, the back platform 181 and the first seat platform 182*a* on one side and the second seat platform 182*b*, the thigh platform 183 and the foot platform 184 on the other side occupy the similar space, as shown in FIG. 10, which is convenient for package and/or storage.

In some embodiments, the base structure 110 comprises a pair of side rails, an upper rail, an intermediate rail and a lower rail, each of which is a straight rail. The pair of side rails is transversely spaced, longitudinally aligned and arranged parallel to each other. Each side rail has an upper end portion and an opposite, lower end portion. Two ends of the upper rail are connected to the upper end portions of the pair of side rails; two ends of the lower rail are connected to the lower end portions of the pair of side rails; and two ends of the intermediate rail are connected to the pair of side rails at a position between the upper end portions and the lower end portions of the pair of side rails, such that the pair of side rails, the upper rail, the intermediate rail and the lower rail are rectangle forms.

In some embodiments, the bed frame 120 comprises a first bed frame 120A and a second bed frame 120B slidably arranged on the base structure 110. Each of the first bed frame 120A and the second bed frame 120B has a pair of side rails 123 or 127, an upper rail 121 or 125 and a lower rail 122 or 126, each of which is a straight rail. The pair of side rails is transversely spaced, longitudinally aligned and arranged parallel to each other. The upper rail and the lower rail are rigidly connected to the pair of side rails such that the pair of side rails, the upper rail, and the lower rail are in a rectangle form.

In some embodiments, each side rail of the base structure includes a guiding means, and each side rail of the first bed frame and the second bed frame includes at least one slider slidably received in the respective guiding means.

In some embodiments, each side rail of the base structure is formed of a C-shaped steel having a C-channel, and each side rail of the first bed frame and the second bed frame includes at least one wheel slidably received in the respective C-channel.

In some embodiments, the back lifting actuator 140 comprises a motor member 146, an outer tube 147 extending from the motor member 146, an activation rod 148 received in the outer tube 147, engaged with the motor member 146 and configured to be telescopically expandable or contractible relative to the outer tube 147 according to a direction of motor rotation, wherein the motor member 146 is pivotally connected to the intermediate rail 112 of the base structure 110, and the activation rod 148 has a distal end portion pivotally connected to the upper rail 121 of the first bed frame 120A, or the motor member 146 is pivotally connected to the upper rail 121 of the first bed frame 120A, and the activation rod 148 has a distal end portion pivotally connected to the intermediate rail 112 of the first base structure 110A.

In some embodiments, the foot lifting bracket 151 comprises a pair of swing arms 153 and a middle bar 152, wherein the pair of swing arms 153 is transversely spaced and longitudinally extended, and rigidly connected to two ends of the transversely extending middle bar 152 in an H-shaped form, and each swing arm 153 has a first end portion and an opposite, second end portion, wherein the first end portion of each swing arm 153 is pivotally mounted to a respective one of the pair of side rails 127 of the second bed frame 120B.

The foot lifting actuator 155 comprises a motor member 156, an outer tube 157 extending from the motor member 155, an activation rod 158 received in the outer tube 156, engaged with the motor member 156 and configured to be telescopically expandable or contractible relative to the outer tube 157 according to a direction of motor rotation, wherein the motor member 156 is pivotally connected to the lower rail 126 of the second bed frame 120B, and the activation rod 158 has a distal end portion pivotally connected to the middle bar 152 of the foot lifting bracket 151, or the motor member 156 is pivotally connected to the middle bar 152 of the foot lifting bracket 151, and the activation rod 158 has a distal end portion pivotally connected to the lower rail 126 of the second bed frame 120B.

In certain embodiments, each of the base structure 110 and the bed frame 120 comprises a pair of side rails, an upper rail, an intermediate rail and a lower rail, each of which is a straight rail. The pair of side rails is transversely spaced, longitudinally aligned and arranged parallel to each other, each side rail having an upper end portion and an opposite, lower end portion; wherein two ends of the upper rail are connected to the upper end portions of the pair of side rails; two ends of the lower rail are connected to the lower end portions of the pair of side rails; and two ends of the intermediate rail are connected to the pair of side rails at a position between the upper end portions and the lower end portions of the pair of side rails, such that the pair of side rails, the upper rail, the intermediate rail and the lower rail are rectangle forms.

In certain embodiments, each side rail of the base structure 110 includes a guiding means, and wherein each side rail of the bed frame 120 includes at least one slider slidably received in the respective guiding means.

In certain embodiments, each side rail of the base structure 110 is formed of a C-shaped steel having a C-channel, and wherein each side rail of the bed frame 120 includes at least one wheel slidably received in the respective C-channel.

In certain embodiments, the back lifting actuator 140 comprises a motor member 146, an outer tube 147 extending from the motor member 146, an activation rod 148 received in the outer tube 147, engaged with the motor member 146 and configured to be telescopically expandable or contractible relative to the outer tube 147 according to a direction of motor rotation, wherein the motor member 146 is pivotally connected to the intermediate rail 112 of the base structure 110, and the activation rod 148 has a distal end portion pivotally connected to the upper rail 121 of the first bed frame 120A, or the motor member 146 is pivotally connected to the upper rail 121 of the first bed frame 120A, and the activation rod 148 has a distal end portion pivotally connected to the intermediate rail 112 of the first base structure 110A.

In certain embodiments, the foot lifting bracket 151 comprises a pair of swing arms 153 and a middle bar 152, wherein the pair of swing arms 153 is transversely spaced and longitudinally extended, and rigidly connected to two ends of the transversely extending middle bar 152 in an H-shaped form, and each swing arm 153 has a first end portion and an opposite, second end portion, wherein the first end portion of each swing arm 153 is pivotally mounted to a respective one of the pair of side rails of the bed frame 120.

The foot lifting actuator 155 comprises a motor member 156, an outer tube 157 extending from the motor member 155, an activation rod 158 received in the outer tube 156, engaged with the motor member 156 and configured to be telescopically expandable or contractible relative to the outer tube 157 according to a direction of motor rotation, wherein the motor member 156 is pivotally connected to the lower rail 126 of the bed frame 120, and the activation rod 158 has a distal end portion pivotally connected to the middle bar 152 of the foot lifting bracket 151, or the motor member 156 is pivotally connected to the middle bar 152 of the foot lifting bracket 151, and the activation rod 158 has a distal end portion pivotally connected to the lower rail 126 of the bed frame 120.

Similarly, in operation, the back lifting actuator drives the bed frame to slidably move on the base structure, which in turn drives the back platform to translationally and rotationally move in desired positions and angles relative to the base structure, and the foot lifting actuator pivotally connected between the foot lifting bracket and the bed frame drives the foot lifting bracket to pivotally move in an upward rotation direction or a downward rotation direction relative to the bed frame, thereby adjusting the positions and angles of the thigh platform and the foot platform accordingly.

According to the invention, the adjustable bed is capable of adjusting body positions at user's preference to achieve maximum comfort when using the bed.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a frame structure comprising: a base structure; a back support member having a first end pivotally and directly connected to the base structure and an opposite, second end; and a bed frame slidably arranged on the base structure;

a driving mechanism comprising a back lifting actuator having a first end and an opposite, second end pivotally and directly connected to the base structure and the bed frame, respectively; and a plurality of platforms including a seat platform fixed to the bed frame and a back platform having an lower edge hinged to the seat platform and a rear side directly hinged to the opposite, second end of the back support member, such that the seat platform is co-movable with the bed frame, and when the seat platform translationally moves, the movement of the seat platform causes the back platform to translationally move along with the movement of the seat platform and rotate around its lower edge hinged to the seat platform, and the back support member to rotate in an opposite direction relative to the back platform, wherein in operation, the back lifting actuator drives the bed frame to slidably move on the base structure, thereby driving the seat platform to translationally move accordingly, and the movement of the seat platform in turn drives the back platform to translationally move along with the movement of the seat platform and rotate around its lower edge hinged to the seat platform and the back support member to rotate in an opposite direction relative to the back platform so as to adjust the back platform in desired positions and angles relative to the base structure;

wherein the driving mechanism further comprises a foot lifting assembly comprising a foot lifting bracket pivotally connected to the bed frame, and a foot lifting actuator pivotally connected between the foot lifting bracket and the bed frame for operably driving the foot lifting bracket to pivotally move in an upward rotation direction or a downward rotation direction relative to the bed frame;

wherein the base structure comprises a first base structure and a second base structure, wherein each of the first base structure and the second base structure has a pair of side rails, an upper rail and a lower rail, wherein the pair of side rails is transversely spaced, longitudinally aligned and arranged parallel to each other, wherein the upper rail and the lower rail are rigidly connected to the pair of side rails such that the pair of side rails, the upper rail, and the lower rail are in a rectangle form, wherein the lower ends of the pair of side rails of the first base structure are pivotally connected to the upper ends of the pair of side rails of the second base structure by a pair of connectors, respectively, so that the first base structure and the second base structure are foldable to each other;

wherein the bed frame comprises a first bed frame and a second bed frame slidably arranged on the first base structure and the second base structure, respectively, wherein each of the first bed frame and the second bed frame has a pair of side rails, an upper rail and a lower rail, wherein the pair of side rails is transversely spaced, longitudinally aligned and arranged parallel to each other, and wherein the upper rail and the lower rail are rigidly connected to the pair of side rails such that the pair of side rails, the upper rail, and the lower rail are in a rectangle form; and wherein the seat platform comprises a first seat platform fixed on the first bed frame, and a second seat platform fixed on the second bed frame and hinged to the first seat platform by a pair of hinges, wherein each hinge has a middle bar and a pair of side bars, wherein each side bar has one end pivotally connected to the middle bar and another end fixed to a respective one of the first seat platform and the second seat platform, such that when the adjustable bed is in a flat position or a folded position, the middle bar of the hinge and the connector on a same side of the adjustable bed are projectively overlapped along a transverse direction of the adjustable bed.

2. The adjustable bed of claim 1, wherein the plurality of platforms further comprises a thigh platform hinged to the seat platform and a foot platform hinged to the thigh platform, wherein the thigh platform and the foot platform are co-movably coupled with the foot lifting bracket, such that positions and angles of the thigh platform and the foot platform are adjustable by the foot lifting bracket.

3. The adjustable bed of claim 1, wherein each side rail of the first base structure and the second base structure includes a guiding means, and wherein each side rail of the first bed frame and the second bed frame includes at least one slider slidably received in the respective guiding means.

4. The adjustable bed of claim 3, wherein each side rail of the first base structure and the second base structure is formed of a C-shaped steel having a C-channel, and wherein each side rail of the first bed frame and the second bed frame includes at least one wheel slidably received in the respective C-channel.

5. The adjustable bed of claim 1, wherein the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally and directly connected to the lower rail of the first base structure, and the activation rod has a distal end portion pivotally and directly connected to the upper rail of the first bed frame, or the motor member is pivotally and directly connected to the upper rail of the first bed frame, and the activation rod has a distal end portion and directly pivotally connected to the lower rail of the first base structure.

6. The adjustable bed of claim 1, wherein the foot lifting bracket comprises a pair of swing arms and a middle bar, wherein the pair of swing arms is transversely spaced and longitudinally extended, and rigidly connected to two ends of the transversely extending middle bar in an H-shaped form, and each swing arm has a first end portion and an opposite, second end portion, wherein the first end portion of each swing arm is pivotally mounted to a respective one of the pair of side rails of the second bed frame; and the foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the second bed frame, and the activation rod has a distal end portion pivotally connected to the middle bar of the foot lifting bracket, or the motor member is pivotally connected to the middle bar of the foot lifting bracket, and the activation rod has a distal end portion pivotally connected to the lower rail of the second bed frame.

7. The adjustable bed of claim 6, wherein the second end portion of each of the pair of swing arms is equipped with at least one foot lifting wheel.

* * * * *